United States Patent [19]

Isaak

[11] 3,946,695

[45] Mar. 30, 1976

[54] SELF-DEPLOYING MULTIPLE ANCHOR MOORING SYSTEMS

[75] Inventor: Robert D. Isaak, Bellevue, Wash.

[73] Assignee: Honeywell Inc., Minneapolis, Minn.

[22] Filed: Apr. 28, 1975

[21] Appl. No.: 572,361

[52] U.S. Cl. ..... 114/206 R; 9/8 R

[51] Int. Cl.[2] ..... B63B 21/24

[58] Field of Search ..... 114/206 R–210, 114/235 B; 9/8 R; 102/13, 15

[56] References Cited

UNITED STATES PATENTS

| | | | |
|---|---|---|---|
| 3,032,000 | 5/1962 | Feiler | 114/206 R |
| 3,125,980 | 3/1964 | Anderson | 114/235 B |
| 3,159,806 | 12/1964 | Piasecki | 114/235 B |
| 3,295,153 | 1/1967 | Dessau | 114/206 R |
| 3,611,974 | 10/1971 | Joppa et al. | 114/206 R |
| 3,631,550 | 1/1972 | Bullen | 9/8 R |

*Primary Examiner*—Trygve M. Blix
*Assistant Examiner*—Jesus D. Sotelo

[57] ABSTRACT

A multiple anchor marine mooring system wherein a plurality of anchors capable of stably gliding through water at a fixed depression once a minimum glide velocity is attained are secured to a carrier in a compact cluster. The cluster is configured so that gravity alone will accelerate it in water to glide velocity, whereupon the anchors are automatically released for self-emplacement.

11 Claims, 7 Drawing Figures

SELF-DEPLOYING MULTIPLE ANCHOR MOORING SYSTEMS

BACKGROUND OF THE INVENTION

This invention relates generally to marine mooring systems, and more specifically to multiple anchor systems wherein the anchors are self-emplacing. It has particular applicability to buoy systems wherein rapid and simple installation and maintenance of stable buoy position are required.

There are a significant and increasing number of requirements for easily deployable mooring systems for buoyant marine objects. It is frequently a further requirement that such mooring systems be capable of maintaining tight positional control of the buoyant objects under relatively severe environmental conditions, including adverse conditions of wind, waves and tidal currents. Examples of applications requiring such mooring systems include positional markers for marine navigation, fire fighting, diving operations, and identification of underwater points of interest; mooring apparatus for marine surveillance devices and instruments for obtaining hydrographic data and information on marine life; and anchoring devices for surface and subsurface pipe lines, storage tanks and marine vessels supporting underwater operations.

A large variety of methods and apparatus have been and/or are now employed for maintaining the positions of buoyant marine objects. One of the simplest systems involves tethering the buoyant object to a single underwater dead weight anchor by means of a chain or cable. Best positional control in such a system is achieved by maintaining the cable under substantial tension. This requires a massive anchor and a highly buoyant object. Thus, the system tends to be large and heavy for the function it performs, and is frequently not suitable for deployment from an aircraft or small vessel. In addition, even where substantial cable tension is maintained, positional control over the buoyant object is not particularly tight.

Much tighter positional control can be maintained by means of a mooring system which employs multiple spaced anchors. However, such systems generally suffer from the disadvantage of difficult and complex anchor emplacement procedures. This problem is aggravated if the system must be deployed under adverse wind, wave and current conditions. Multiple anchor system deployment procedures generally require at least two surface vessels. Typically the first of the plurality of anchors is lowered by one vessel while another vessel carries a second anchor to a spaced location at which time, the first vessel moves to yet another spaced location for emplacement of another anchor. In addition to requiring a substantial amount of marine equipment, there are problems in maintaining the anchor cables clear of one another while the system is being deployed.

Some of these disadvantages are overcome in mooring systems such as those disclosed in U.S. Pat. Nos. 3,295,153 and 3,611,974 issued to H. R. Dessau and R. G. Joppa et al. respectively. In each of these systems, a plurality of anchors are initially secured to guide rails on a floating structure. In the system disclosed in U.S Pat. No. 3,295,153, each anchor includes an element similar to a conventional fluked anchor attached to a torpedo-like cable carrier. During the deployment process the cable carriers are propelled by means of gas cartridges, and horizontally plane outwardly from a central flotation section. They simultaneously pay out cable secured to the central flotation section until their power is expended, after which they sink to the bottom.

In the system disclosed in U.S Pat. No. 3,611,974, guide rails on a surface vessel are oriented in the directions of desired anchor emplacement. When anchor deployment is desired, the anchors are accelerated along the guide rails by means of springs so as to impart a velocity sufficient to achieve stable gliding of the anchors. In both of these systems, the guide rail arrangements are cumbersome and require substantial space. In addition, special propulsion means is required to carry the anchors to their desired positions. The volume and weight of such systems makes them unsuitable for deployment from some aircraft and small marine vessels. In addition, the requirement for a special propulsion system is undesirable from the standpoint of manufacturing expense, maintenance, and reliability.

The applicant has overcome these problems by providing a multiple anchor mooring system wherein, prior to deployment, a plurality of gliding anchors are secured in a compact cluster. When deployment is desired, acceleration of the cluster to a velocity at least equal to the stable gliding velocity of the anchors may be provided by gravitational forces alone. The anchors are then automatically released to glide to their desired positions. Release of the anchors at a subsurface location results in accurate and predictable anchor emplacement wherein final anchor positioning is relatively unaffected by surface swells, currents and wind. Thus, an easily and accurately emplaceable multiple anchor mooring system of maximum simplicity and sufficient compactness for deployment from an aircraft or small surface vessel is achieved.

SUMMARY OF THE INVENTION

The invention herein described is a self-emplacing multiple anchor marine mooring system utilizing anchors of a type which stably glide through water at a fixed azimuth and depression once a minimum glide velocity is attained. A plurality of such anchors are secured in a compact cluster on a launcher pod or carrier. The anchor cluster is configured to be accelerated by gravity alone to a velocity at least as great as the minimum glide velocity. For certain specialized applications in which very rapid deployment is imperative, propulsion means may be provided to augment the effect of gravitational forces in accelerating the cluster.

The carrier includes means for sensing velocity of the cluster and releasing the anchors once a suitable velocity is reached. The anchors are connected to a buoyant body by cables. Means may be provided for taking up portions of the cables after the anchors are emplaced to provide desired cable tension and/or buoyant body position.

A principal object of this invention is to provide a self-emplacing multiple anchor marine mooring system of maximum simplicity.

A further object is to provide a marine mooring system in which a plurality of anchors may be emplaced at spaced locations utilizing gravity alone to provide motive power.

Yet a further object is to provide a unique multiple anchor marine mooring system which, prior to deployment, is sufficiently compact and light weight to be deployed from an aircraft or relatively small marine vessel.

An additional object is to provide a marine mooring system whose deployment is minimally affected by adverse surface conditions such as wind and waves.

Additional objects of the present invention may be ascertained from a study of the drawings, disclosure and appended claims.

DESCRIPTION OF THE PREFERRED EMBODIMENT

Figure 1C:
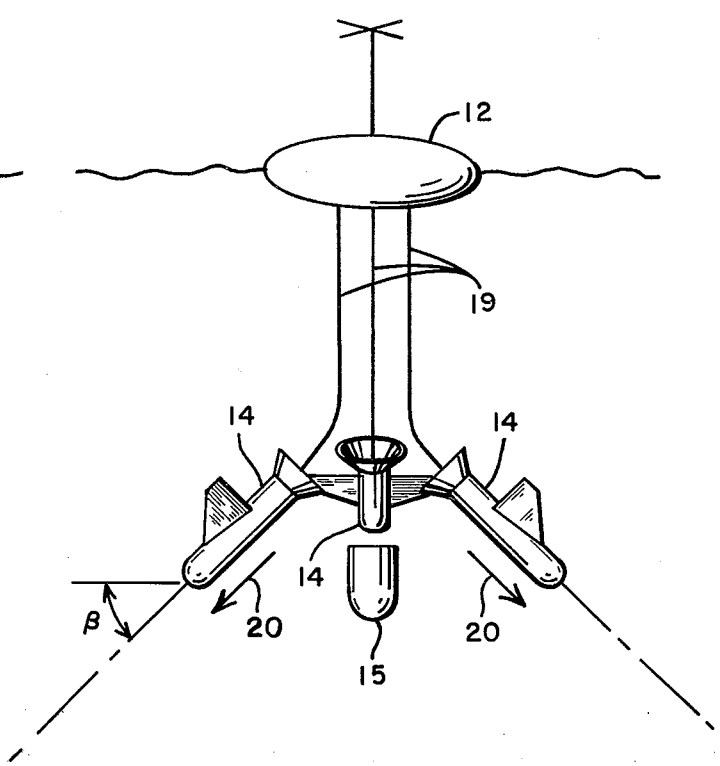
FIGS. 1*a*–1*d* sequentially illustrate a multiple anchor marine mooring system in accordance with the applicant's invention at selected times during the deployment process.
Figure 1B:
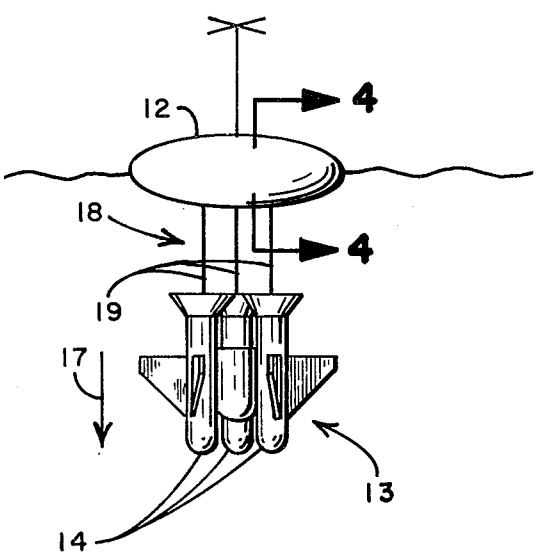
Figure 1A:
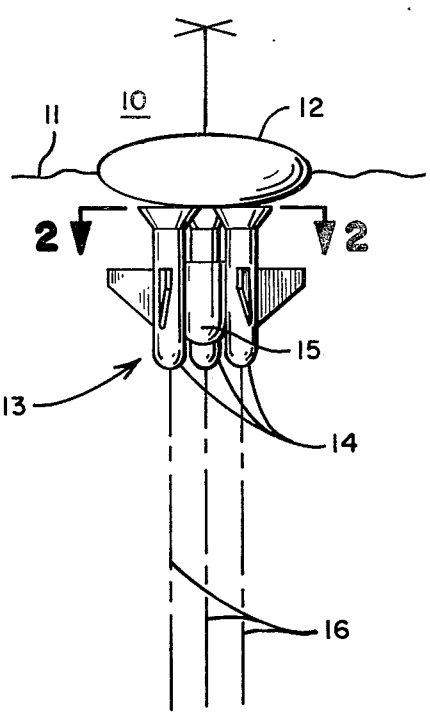

In FIG. 1a, an undeployed multiple anchor marine mooring system, as generally identified by reference numeral 10, is shown floating on the surface 11 of a body of water. System 10, which may have been launched from an aircraft or marine vessel (not shown), generally comprises a buoyant body 12 and an anchor cluster generally identified by reference numeral 13. System 10 is illustrated as having a net buoyancy in water. However, the applicant's invention is equally applicable to systems in which body 12 is buoyant in water only after separation from anchor cluster 13.

Cluster 13 is shown as comprising three gliding anchors 14 arranged around a central carrier or launcher pod 15. Cluster 13 is shown initially secured to body 12. The attachment of cluster 13 to body 12 may be provided by any suitable securing arrangement which can be released upon command.

Gliding anchors 14 are of a type which stably glide through water at a fixed azimuth and depression after reaching a velocity at least equal to a minimum glide velocity determined by the anchor configuration. Such an anchor is disclosed in detail in previously identified U.S. Pat. No. 3,611,974. Anchors of this type require a minimum glide velocity to achieve stable glide characteristics. Therefore, such anchors must be maintained in a predetermined orientation until minimum glide velocity is reached in order to achieve accurate final anchor positioning.

As shown, anchors 14 are basically passive dead weight anchors. In applications requiring increased holding power per unit of anchor weight, anchors 14 may be explosively embedded. Gliding anchors are well adapted for inclusion of explosive embedment apparatus in that anchor attitude at contact with the sea bottom is well defined. Previously identified U.S. Pat. No. 3,295,153 discloses explosive embedment anchor features suitable for incorporation in anchors 14.

Figure 2:
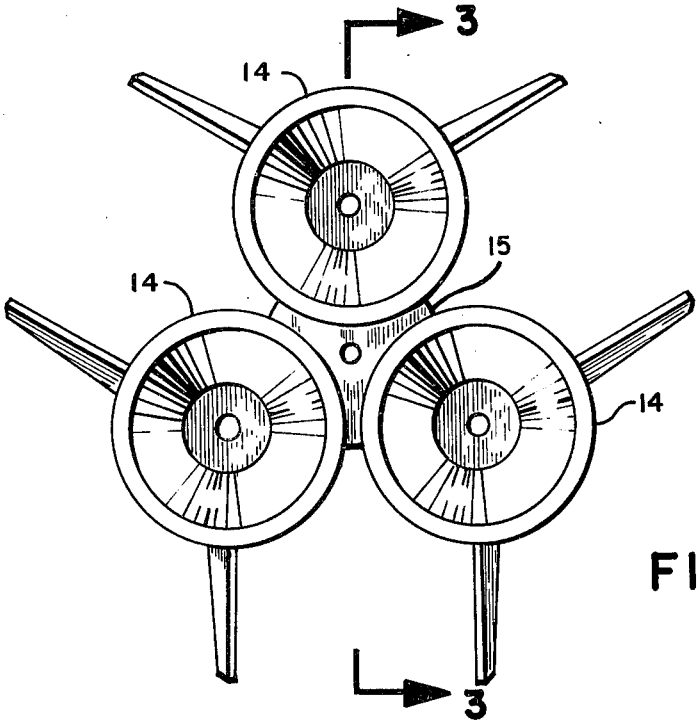
FIG. 2 is a pictorial view of an anchor cluster and carrier employed in the system of FIG. 1 taken as indicated at line 2—2 in FIG. 1*a;*

Reference numeral 16 identifies central longitudinal axes of anchors 14. Anchors 14 may be maintained in a very compact cluster by mounting them on carrier 15 so that axes 16 are substantially parallel. As shown more clearly in FIG. 2, anchors 14 are equally spaced around carrier 15. In a system employing three anchors as illustrated, anchors 14 have azimuthal separations of 120°. It should, however, be noted that the applicant's invention is not limited to systems employing only three gliding anchors. In systems employing more than three gliding anchors, a larger carrier may be necessary and a different angular spacing of the anchors may be used.

Anchor cluster 13 is configured to have a preferred direction of travel through water substantially parallel to axes 16. Also, carrier 15 may be configured by means of fins, etc. to ensure a straight vertical drop without rotation as indicated by arrow 17 in FIG. 1b.

Anchor cluster 13 is configured so that gravitational forces alone will accelerate the cluster in water to at least the minimum glide velocity of anchors 14. This results in a system of maximum simplicity and is suitable for many marine mooring system applications. In other applications, such as systems for mooring position reference buoys for marine fire fighting equipment, auxilliary propulsion means may be advantageously included to minimize deployment time. Such propulsion means may take the form of gas cartriges, as shown in U.S. Pat. No. 3,295,153, on carrier 15 and/or anchors 14.

Figure 3:
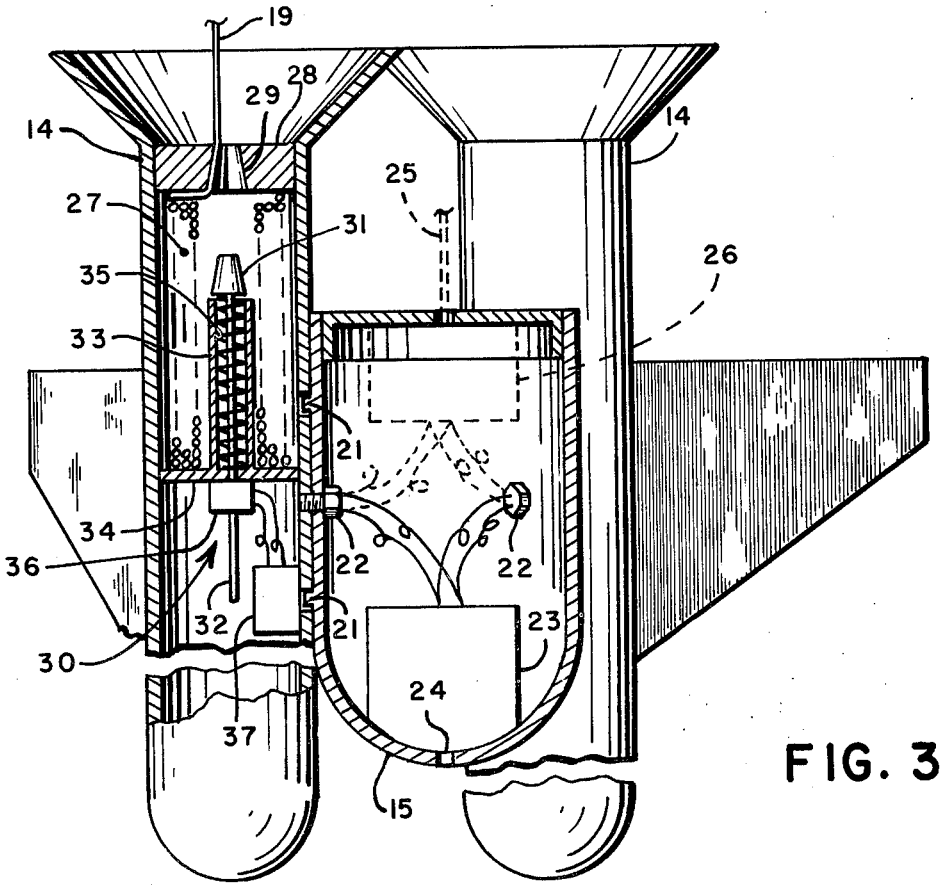
FIG. 3 is an enlarged, rotated cross-sectional view of the anchor cluster of FIG. 2 taken as indicated at line 3—3, showing suitable anchor release and cable pay out arrangements.

FIG. 1*b* shows the applicant's mooring system shortly after anchor cluster 13 has been released from buoyant body 12, but before the anchor cluster has reached the minimum glide velocity of anchors 14. Cable means generally identified by reference numeral 18 extend between body 12 and cluster 13. Cable means 18 is shown comprising a separate cable 19 between body 12 and each anchor 14. Cables 19 are contained in fast pay out cannisters or drums which may be housed in either body 12 or anchors 14. In the disclosed embodiment the cable is contained in the anchors as shown in FIG. 3.

FIG. 1c illustrates the system after the anchor cluster has achieved the minimum glide velocity, and shortly after anchors 14 have been released from carrier 15. As described in previously identified U.S. Pat. No. 3,611,974, anchors 14 are capable of gliding downwardly through water at a fixed depression angle once having attained at least the minimum glide velocity. The preferred direction of anchor travel is illustrated in FIG. 1*c* by arrows 20. The depression angle, designated $\beta$, is 45° for the patented anchor configuration.

As illustrated in FIG. 1c, carrier 15 is expendable. After release of anchors 14, carrier 15 continues to sink to the sea bottom. Alternatively, carrier 15 may be attached to an additional anchor cable, or may be attached to buoyant body 12 by means of a fixed length lanyard. Such a lanyard may be used for anchor release purposes as will be described hereinafter.

Figure 1D:
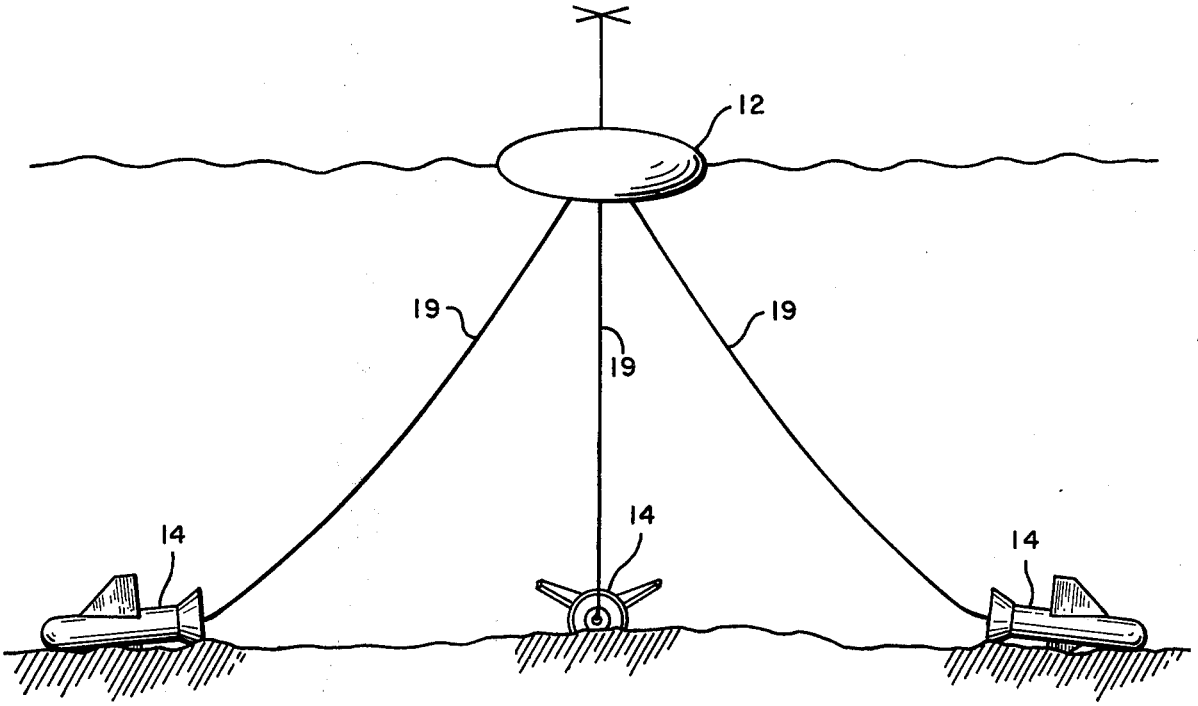

Anchor system 10 is shown fully deployed in FIG. 1*d*. Each anchor 14 has continued to the sea bottom along a substantially linear path determined in azimuth by the original position of the anchor on carrier 15, and in depression by the design parameters of the anchor. After reaching the bottom, a braking mechanism prevents further pay out of cable 19. Cable take up means may be provided for achieving proper final tension of anchor cables 19 and/or a proper submersion level of body 12. Suitable embodiments of cable brake and cable take up mechanisms are illustrated and will be described in connection with FIGS. 3 and 4.

In accordance with FIG. 3, anchors 14 and carrier 15 have cavities therein for housing certain sensor, anchor release and cable handling mechanisms. Anchors 14 are shown located on carrier 15 by means of a pair of protrusions 21 on the carrier which mate with recesses in the anchor bodies. Anchors 14 are secured to carrier 15 by releasable securing means 22 such as electrically actuated explosive bolts. Other suitable securing means include electrically or electromagnetically actuated latches or force sensitive mechanical links which fracture upon occurrence of sufficient force caused by hydrostatic pressure on the anchors.

One suitable device for providing an electrical signal for triggering explosive bolts 22 is a velocity sensor 23 which determines velocity from hydrostatic pressure through a port 24 in the nose of carrier 15. Sensor 23 operates to supply an electrical signal to bolts 22 upon sensing a pressure corresponding to a predetermined velocity at least as great as the minimum stable glide velocity of anchors 14.

Another suitable implementation of a system for releasing anchors 14 involves the use of a fixed length lanyard, identified by reference numeral 25, between body 12 and carrier 15. The length of the lanyard is sufficient to permit carrier 15 to fall a distance predetermined to permit anchor cluster 13 to have reached at least the minimum stable glide velocity. A switch or voltage source 26 actuated by lanyard 15 may be employed to produce the electrical signal for triggering explosive bolts 22.

A portion of the cavity in each anchor 14 is shown forming a cannister for a coil 27 of anchor cable. The rearward portion of the cannister is formed by a plug 28 secured to the anchor housing, and having a centrally located tapered aperture 29 therethrough. Cable coil 27 is arranged so that as anchor 14 glides downwardly, cable 19 unwinds from the center of the coil and pays out through aperture 29. A braking mechanism generally identified by reference numeral 30 is provided for preventing further pay out of cable 19 after anchor 14 impacts the sea bottom.

Braking mechanism 30 is shown comprising a tapered ram head 31 on the end of a shaft 32 which is slidably carried in a tubular guide member 33. Guide member 33 forms a portion of a structural plate member 34 which defines the forward end of the cannister for cable coil 27. Plate member 34 is rigidly fixed to the body of anchor 14. A coil spring 35 surrounds shaft 32 and is compressed between ram head 31 and an internal shoulder on plate 34 surrounding shaft 32. Guide member 33 is aligned with aperture 29. Ram head 31 is tapered to correspond with the taper of aperture 29. Ram head 31 is normally restrained in a retracted position by means of an explosively separable collar 36 surrounding shaft 32 forward of plate member 34.

Collar 36 is triggered by an electrical signal produced by a sensor 37. Sensor 37 may be of a type which is impact sensitive so as to produce an electrical signal when anchor 14 impacts the sea bottom. The electrical signal supplied from sensor 37 to collar 36 causes it to release shaft 32, thereby permitting ram head 31 to be forced into aperture 29. Cable 19 is, thus, jammed in aperture 29 and further pay out is prevented. In systems employing explosively embedded anchors, the signal produced by sensor 37 may also be used to actuate the embedment apparatus.

Figure 4:
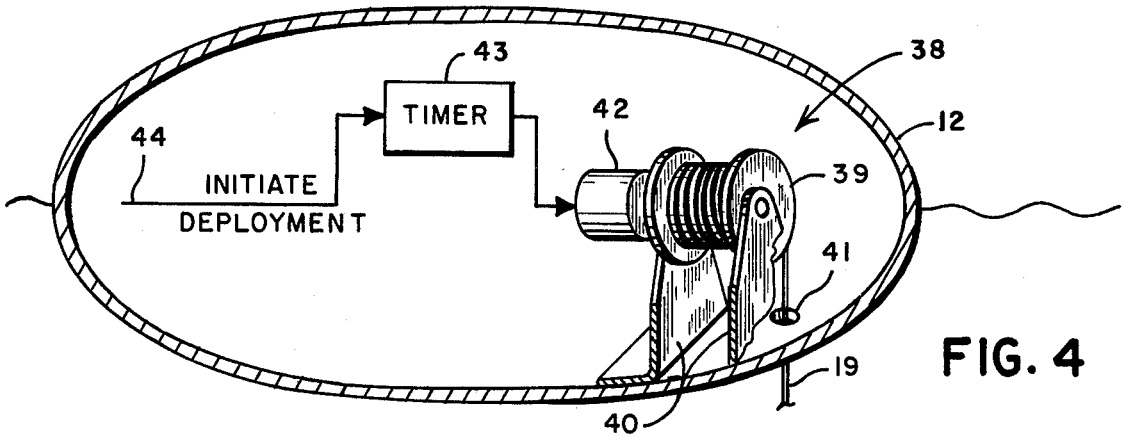
FIG. 4 is a cross-sectional view of the buoyant body shown in FIG. 1 taken as indicated at line 4—4 in FIG. 1b, showing a suitable cable take up arrangement.

FIG. 4 illustrates apparatus for suitably tensioning cables 19 after anchors 14 are fully deployed. Tensioning is provided by cable take up means generally identified by reference numeral 38. Cable take up means 38 is housed within buoyant body 12. A separate cable take up device is provided for each anchor cable 19. In the embodiment shown, cable take up means 38 comprises a winch having a reel 39 mounted for rotation between support brackets 40. Cable 19 extends through an aperture 41 in the housing of buoyant body 12 to reel 39. Reel 39 is driven by a suitable reel drive device 42 which may be powered electrically, or mechanically by means of a spring. If the requirement is for predetermined tensioning of anchor cable 19, such tensioning may be accomplished by means of a slip clutch in reel drive device 42. Alternatively, if the requirement is for pulling buoyant body 12 to a predetermined depth, a suitable sensor for determining depth may be provided along with apparatus and interconnections for terminating operation of reel drive device 42 and locking reel 39 at the proper time. Proper depth may, for example, be determined by a pressure sensor.

Although not shown for purposes of avoiding extraneous material in FIG. 4, cable take up means 38 may be enclosed within a fluid tight compartment which covers aperture 41 so as to prevent body 12 from filling with water and losing its buoyancy. Alternatively, buoyancy may be provided by separate flotation devices of chambers.

Operation of reel drive device 42 may be started by means of a timer 43. As illustrated, timer operation is initiated by a "initiate deployment" signal shown at 44. Timer 43 is set to time an interval after the "initiate deployment" signal sufficient to permit all of anchors 14 to reach the sea bottom. After that interval, timer 43 starts operation of reel drive device 42 to provide appropriate tension in cables 19 and/or depth of buoyant body 12. Although a timer is shown for starting operation of cable take up means 38, other equally suitable arrangements may be provided for accomplishing the same function.

The applicant's self-deploying multiple anchor marine mooring system is made ready for operation by launching the system, as shown in FIG. 1, in a body of water. This may be accomplished by an aircraft or marine vessel. Once in the water, deployment of the anchors may be initiated either remotely by means of a radio signal or by means of a self-contained sensor or timer apparatus. In the disclosed embodiment, initiation of the deployment process results in releasing of anchor cluster 13 from buoyant body 12 and initiating operation of timer 43. Anchor cluster 14 is accelerated downwardly by means of gravity alone (or gravity augmented with other propulsion means) as shown in FIG. 1*b*. Anchor cluster 13 eventually reaches a velocity equal to the minimum stable glide velocity of anchors 14. This velocity is either sensed directly by sensor 23 or indirectly from cluster 13 having traveled the length of lanyard 25. Sensor 23 or sensor 26 then supplies an electrical signal to explosive bolts 22 which release anchors 14 from cluster 13. The anchors automatically assume glide paths having azimuths as determined by mounting orientation of the anchors on carrier 15, and depressions as determined by anchor configuration. Anchors 14 continue toward the sea bottom along their established glide paths. As individual anchors 14 impact the bottom, sensors 37 therein supply electrical signals to explosive collars 36, thus releasing shafts 32. This results in tapered ram heads 31 being forced into apertures 29, thereby preventing further pay out of cables 19. Timer 43 subsequently produces a signal initiating operation of reel drive devices 42, thereby taking up cables 19 on reels 39. Cables 19 continue to be taken up on reels 39 until proper cable tensions are achieved as determined by the slip clutches (or other sensor mechanisms) in reel drive devices 42.

In accordance with the foregoing description, the applicant has provided a unique multiple anchor marine mooring system wherein, prior to deployment, a plurality of gliding anchors are secured in a compact cluster. Thus, the system is of maximum compactness for deployment from an aircraft or small surface vessel. Upon initiation of the deployment process, acceleration of the cluster to a velocity which permits stable gliding of the anchors, and thus accurate anchor emplacement may be provided by gravitational forces alone. Use of a plurality of accurately spaced anchors permits tight positional control of the buoyant body. Use of gravitational forces to achieve anchor emplacement provides for a system of maximum simplicity.

Although a preferred embodiment of the applicant's mooring system has been disclosed in detail, other embodiments which do not depart from the applicant's contemplation and teaching will be apparent to those skilled in the art. The applicant does not intend that coverage be limited to the disclosed embodiment, but only by the terms of the appended claims.

What is claimed is:

1. A multiple anchor marine mooring system comprising:

a plurality of marine anchors, each configured to stably glide through water at a predetermined depression when at a velocity at least as great as its minimum glide velocity;

carrier means for securing said plurality of anchors in a cluster having a terminal velocity in water at least as great as the minimum glide velocity of the anchors, said carrier means including a release system for releasing said plurality of anchors when the cluster attains a velocity at least as great as the minimum glide velocity;

a buoyant body; and cable means for connecting said plurality of anchors to said buoyant body.

2. The mooring system of claim 1 wherein:

each of said plurality of anchors is essentially a dead weight anchor which is accelerated by gravity alone, and each has a preferred direction of travel substantially parallel to a longitudinal axis thereof;

said carrier means secures said plurality of anchors in the cluster so that the longitudinal axes thereof are substantially parallel;

the cluster has a preferred direction of travel parallel with the longitudinal axes of said anchors; and the terminal velocity of the cluster in water is greater than the minimum glide velocity.

3. The mooring system of claim 2 wherein the cluster comprises three anchors secured to said carrier means at 120° azimuthal spacings.

4. The mooring system of claim 3 wherein said release system includes releasable securing means for releasing said plurality of anchors in response to a control signal, and a velocity sensor for supplying the control signal when the cluster reaches a predetermined velocity in water at least as great as the minimum glide velocity.

5. The mooring system of claim 4 wherein:

said cable means comprises a cable connecting each of said plurality of anchors to said buoyant body; and further including cable take up means for shortening the cables in accordance with predetermined criteria after said plurality of anchors are emplaced.

6. In a self-deploying marine mooring system of the type including a buoyant body from which multiple nondeployed anchors are released for emplacement in a spaced relationship on the bottom of a body of water and cable means for connecting the buoyant body to the anchors, the improvement which comprises:

a plurality of marine anchors of a type capable of stably gliding through water at a fixed azimuth and depression when at a velocity at least as great as a minimum glide velocity; and carrier means for initially securing said plurality of anchors in a cluster for deployment in the body of water, and releasing said plurality of anchors when the cluster attains a predetermined velocity at least as great as the minimum glide velocity.

7. The mooring system of claim 6 wherein each of said plurality of anchors is essentially a dead weight anchor having a preferred direction of travel substantially parallel to a longitudinal axis thereof.

8. The mooring system of claim 7 wherein said carrier means secures said anchors in the cluster so that the longitudinal axes thereof are substantially parallel;

the cluster has a preferred direction of travel parallel with the longitudinal axes of the anchors in the cluster; and the terminal velocity of the cluster in water as a result of gravitational forces alone is greater than the minimum glide velocity.

9. The mooring system of claim 8 wherein the cluster comprises three anchors secured to said carrier means at 120° azimuthal spacings.

10. The mooring system of claim 9 wherein said carrier means includes releasable securing means for releasing said plurality of anchors in response to a control signal; and a velocity sensor for supplying the control signal when the cluster reaches a predetermined velocity in water at least as great as the minimum glide velocity.

11. The mooring system of claim 10 wherein:

said cable means comprises a cable connecting each of said plurality of anchors to the buoyant body; and further includes cable take up means for shortening the cable between each of said plurality of anchors and the buoyant body in accordance with predetermined criteria after said plurality of anchors are emplaced.

* * * * *